US008167669B1

(12) United States Patent
Xie et al.

(10) Patent No.: US 8,167,669 B1
(45) Date of Patent: May 1, 2012

(54) GRIP OF OAR

(76) Inventors: Cai-Ling Xie, Changhua (TW); Andy C. Teng, Xizhi (TW)

( * ) Notice: Subject to any disclaimer, the term of this patent is extended or adjusted under 35 U.S.C. 154(b) by 0 days.

(21) Appl. No.: 12/963,554

(22) Filed: Dec. 8, 2010

(51) Int. Cl.
*B63H 16/04* (2006.01)

(52) U.S. Cl. ..... 440/102; 440/101; 16/900; 16/430

(58) Field of Classification Search ..... 440/101, 440/102; 416/70 R; 16/110.1, 430, 900
See application file for complete search history.

(56) References Cited

U.S. PATENT DOCUMENTS 3,970,032 A * 7/1976 Phillips ..... 440/102

* cited by examiner

*Primary Examiner* — Edwin Swinehart
(74) *Attorney, Agent, or Firm* — Pro-Techtor Int'l Services

(57) ABSTRACT

An oar includes a retractable shaft with a blade and a grip connected to two ends thereof. A socket is connected to the shaft by a pin and includes a first toothed surface on the end surface of the socket. The grip includes a tubular portion which is mounted to the socket. A spring and a bolt are located in the socket, and the bolt is securely connected with the grip so that the spring is biased between the grip and the head of the bolt. The tubular portion of the grip includes a second toothed surface in an inner end thereof so as to be removably engaged with the first toothed surface of the socket.

3 Claims, 5 Drawing Sheets

GRIP OF OAR

FIELD OF THE INVENTION

The present invention relates to an oar, and more particularly, to a grip rotatably connected to the distal end of the shaft of the oar.

BACKGROUND OF THE INVENTION

A conventional oar is shown in FIG. 1 and generally includes a shaft with a blade and a grip on two ends thereof, the blade is generally parallel to the axis of the grip which is a T-shaped grip. However, the conventional oar has a fixed length so that it occupies space and is difficult to carry or store. FIG. 2 shows another conventional oar which includes a retractable grip which is connected with a section of tubular portion and the section is inserted into the shaft or fixed to the shaft by rotating the section. Nevertheless, the relative angle between the axis of the T-shaped grip and the blade may not be adjusted to be parallel when the grip is secured relative to the shaft. Therefore, the user has to try several times to set the grip at a desired position.

The present invention intends to provide a grip of an oar wherein the grip is easily set at a desired position relative to the blade.

SUMMARY OF THE INVENTION

The present invention relates to an oar and comprises a retractable shaft and a blade is connected to the first end of the shaft. A first hole is defined through a wall of the second end of the shaft. A socket is connected to the second end of the shaft and has a second hole wherein a pin extends through the first hole and the second hole to connect the socket to the shaft. A grip is connected to the socket to form a T-shaped grip and a spring and a bolt are located in the socket, wherein the bolt is securely connected with the grip. The spring is biased between the grip and the bolt. The grip can be pulled and rotated to a desired position and then released to set the grip at the desired position.

The primary object of the present invention is to provide an adjustable grip of an oar wherein the grip can be easily set at the desired position.

The present invention will become more obvious from the following description when taken in connection with the accompanying drawings which show, for purposes of illustration only, a preferred embodiment in accordance with the present invention.

DETAILED DESCRIPTION OF THE PREFERRED EMBODIMENT

Figure 1:
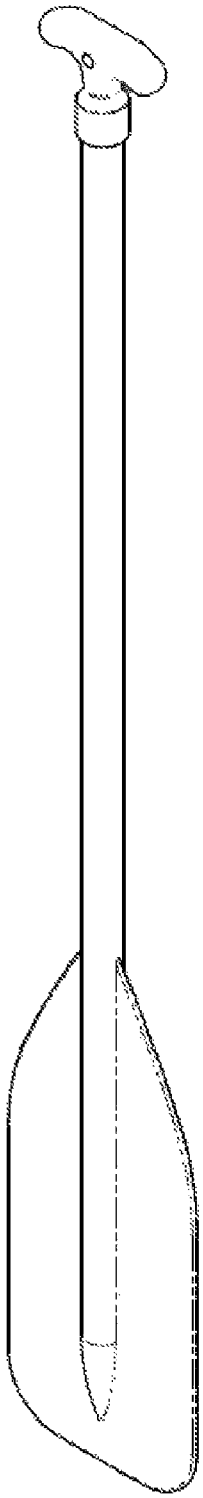
FIG. 1 PRIOR ART
FIG. 1 shows the first conventional oar.
Figure 2:
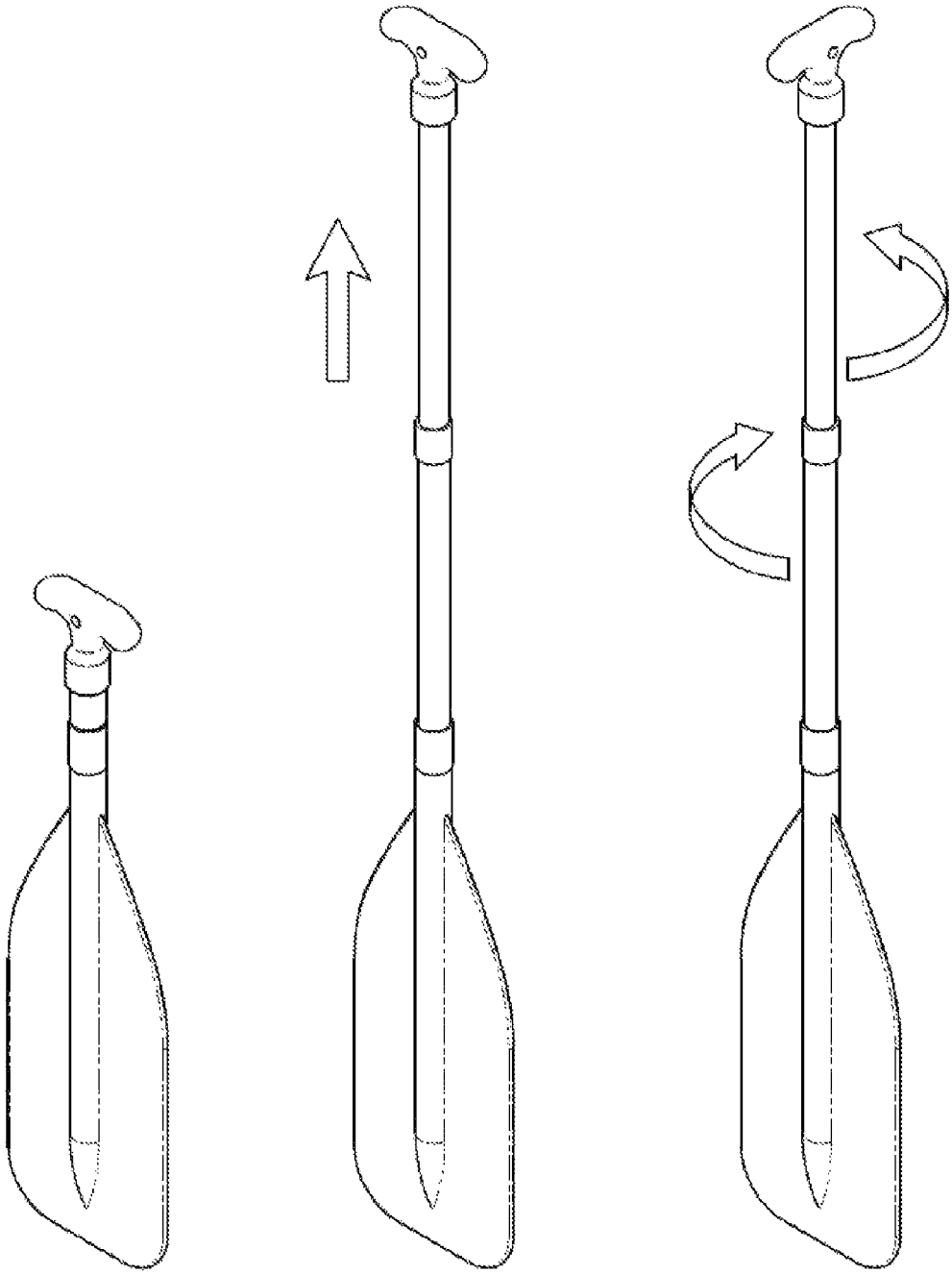
FIG. 2 PRIOR ART
FIG. 2 shows the second conventional oar.
Figure 3:
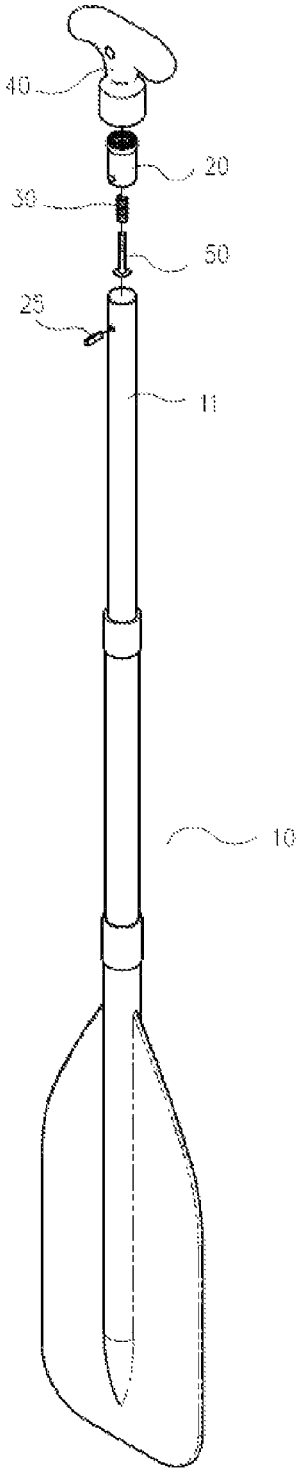
FIG. 3 is an exploded view to show the oar of the present invention.
Figure 4:
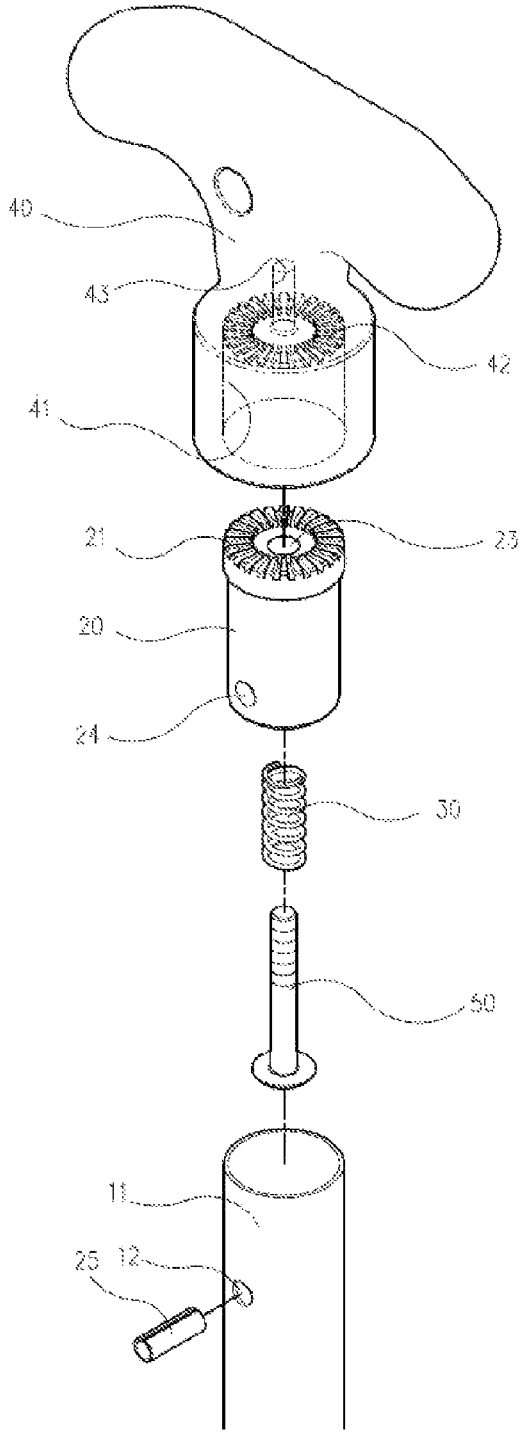
FIG. 4 is an enlarged exploded view to show the oar of the present invention.
Figure 5:
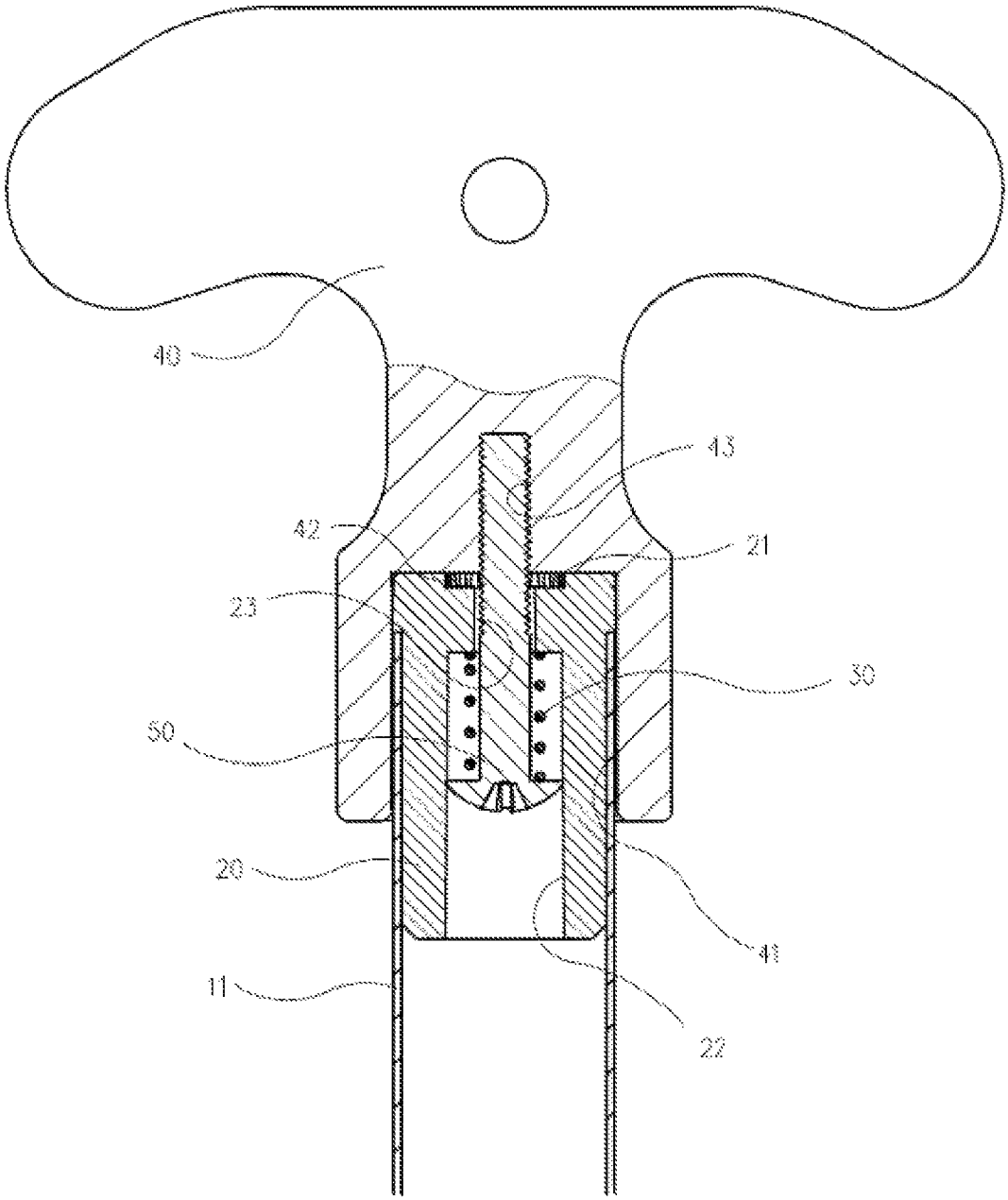
FIG. 5 is a cross sectional view of the connection of the grip and the shaft of the oar of the present invention.

Referring to FIGS. 3 to 5 the oar 10 of the present invention comprises a retractable shaft 11 and a blade is connected to the first end of the shaft 11. A first hole 12 is defined through the wall of the second end of the shaft.

A socket 20 is connected to the second end of the shaft 11 and has a space 22 defined therein, a second hole 24 is defined through the wall of the first end of the socket 20 and a passage 23 is defined through the second end of the socket 20. A first toothed surface 21 is defined in the end of the second end of the socket 20. The socket 20 is inserted into the shaft 10 and a pin 25 extends through the first hole 12 and the second hole 24 to connect the socket 20 to the shaft 11.

A grip 40 is connected to the socket 20 to form a T-shaped grip, wherein the grip 40 includes a tubular portion 41 in which the socket 20 is inserted. A second toothed surface 42 is defined in the inner end of the tubular portion 41, the first and second toothed surfaces 21, 42 are removably engaged with each other. A threaded hole 43 is define din the inner end of the tubular portion 41.

A spring 30 and a bolt 50 are located in the socket 20. The bolt 50 extends through the spring 30 and the passage 23 and is securely connected with the threaded hole 43 in the inner end of the tubular portion 41 of the grip 40. The spring 30 is biased between the grip 40 and the head of the bolt 50.

Figure 6:
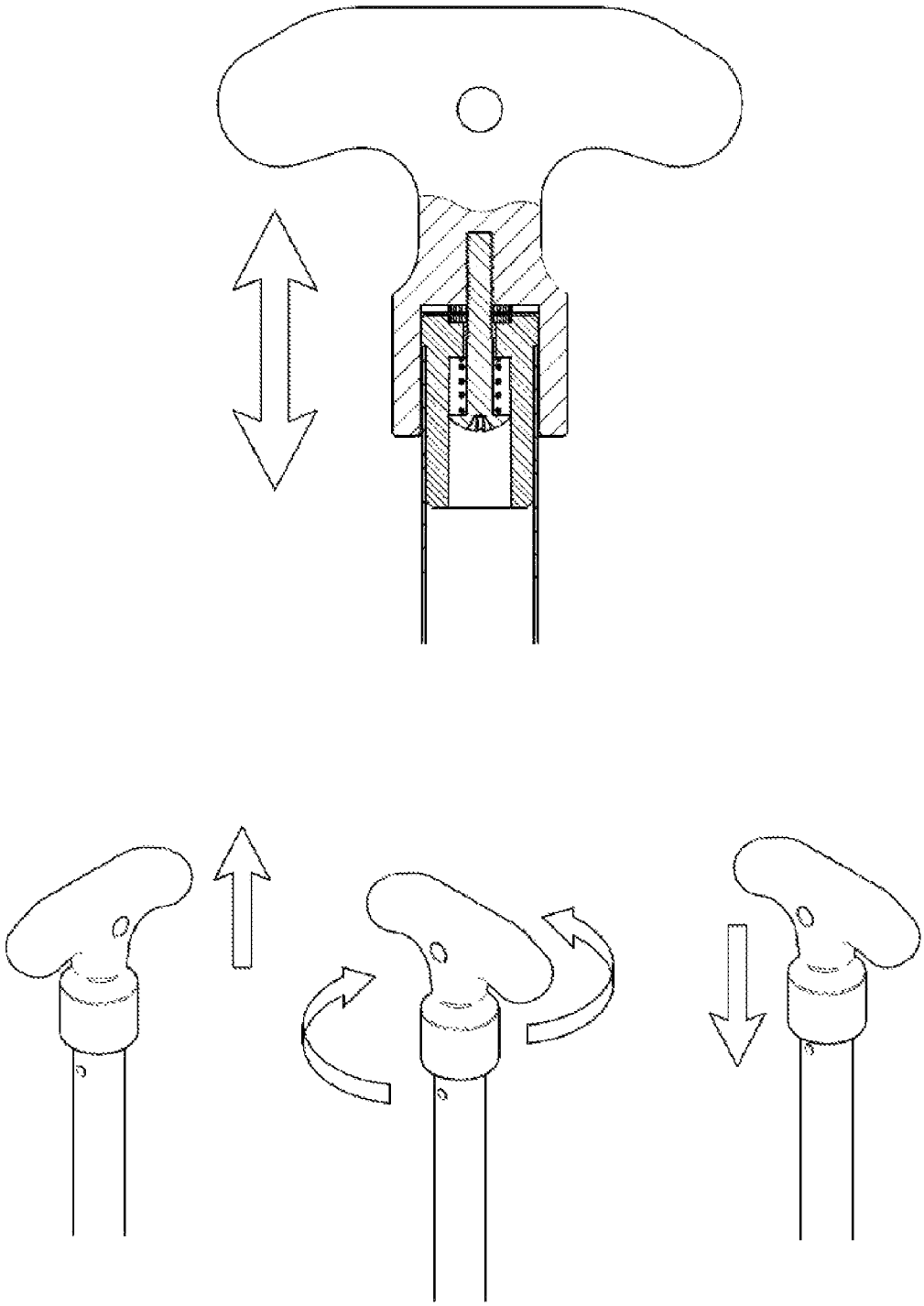
FIG. 6 shows the adjustment or the grip of the oar of the present invention.

As shown in FIG. 6, when adjusting the grip 40, the user pulls the grip 40 to compress the spring 30 so as to separate the first and second toothed surfaces 21, 42, and the grip 40 can be rotated to a desired position. When the grip 40 is rotated to the desired position, the grip 40 is released, the spring force brings the grip 40 back and the first and second toothed surfaces 21, 42 are engaged with each other again to set the grip 40 relative to the blade.

The adjustment of the grip 40 is easy and convenient and improves all of the shortcomings of the conventional oars.

While we have shown and described the embodiment hi accordance with the present invention, it should be clear to those skilled in the art that further embodiments may be made without departing from the scope of the present invention.

What is claimed is:

1. An oar comprising:

a retractable shaft and a blade connected to a first end of the shaft, a first hole defined through a wall of a second end of the shaft;

a socket connected to the second end of the shaft and having a second hole defined through a wall of a first end of the socket, a pin extending through the first hole and the second hole to connect the socket to the shaft;

a grip connected to the socket to form a T-shaped grip;

a spring located in the socket; and a bolt located in the socket and securely connected with the grip, the spring biased between the grip and the bolt.

2. The oar as claimed in claim 1, wherein a first toothed surface is defined in an end a second end of the socket and the grip includes a tubular portion in which the socket is inserted, a second toothed surface is defined in an inner end of the tubular portion, the first and second toothed surfaces are removably engaged with each other.

3. The oar as claimed in claim 2, wherein a threaded hole is defined in the inner end of the tubular portion and the bolt is threadedly engaged with the threaded hole.

* * * * *